US006476301B1

(12) United States Patent
Hepburn

(10) Patent No.: US 6,476,301 B1
(45) Date of Patent: Nov. 5, 2002

(54) BAGPIPE DRONES

(76) Inventor: Ralph Robertson Hepburn, 118 Canongate, The Royal Mile, Edinburgh EH8 8DD (GB)

( * ) Notice: Subject to any disclaimer, the term of this patent is extended or adjusted under 35 U.S.C. 154(b) by 0 days.

(21) Appl. No.: 09/463,248

(22) PCT Filed: Jul. 22, 1998

(86) PCT No.: PCT/GB98/02188

§ 371 (c)(1),
(2), (4) Date: Jan. 21, 2000

(87) PCT Pub. No.: WO99/05670

PCT Pub. Date: Feb. 4, 1999

(30) Foreign Application Priority Data

Jul. 24, 1997 (GB) ..... 9715535

(51) Int. Cl.[7] ..... G10D 7/07
(52) U.S. Cl. ..... 84/380 B; 84/385 B
(58) Field of Search ..... 84/380 B, 385 A, 84/383 R, 380 R

(56) References Cited

U.S. PATENT DOCUMENTS 3,756,112 A * 9/1973 Adams ..... 84/380
4,539,888 A * 9/1985 Whelan ..... 84/380 B
4,714,001 A * 12/1987 Kergomard et al. ..... 84/386
4,838,141 A * 6/1989 Gilbert ..... 84/380 B
5,249,499 A 10/1993 Goldstein et al. ..... 84/386
5,648,623 A * 7/1997 Silverstein et al. ..... 84/383 R
5,959,226 A * 9/1999 Wygent ..... 84/380 B
6,031,168 A * 2/2000 Damm ..... 84/380 B

OTHER PUBLICATIONS

"The New Encyclopaedia Britannica", Encyclopaedia Brittanica, Inc., Chicago, USA, XP002084027, Entry for "Bagpipe", see p. 795.

"Tutor and Text Book", The Royal Scottish Pipe Band Association, Glasgow XP002084028, 1986, "How Tune the Bagpipes", see p. 32, line20–line 33.

* cited by examiner

*Primary Examiner*—Paul Ip
*Assistant Examiner*—Kim Lockett
(74) *Attorney, Agent, or Firm*—Ratner & Prestia

(57) ABSTRACT

A drone is disclosed for use in a set of bagpipes for indoor play, the bagpipes having the drone fitted are substantially smaller and more quiet than conventional bagpipes. Advantageously the drone can be produced in the main from brass tubing which is cheaper than the products used to make conventional bagpipes.

11 Claims, 3 Drawing Sheets

BAGPIPE DRONES

FIELD OF THE INVENTION

This invention relates to the well known Scottish musical instrument commonly called Bagpipese. Highland bagpipes create a distinctive sound through the employment of an inflated bag which may be used to controllably supply air through, typically, three pipes or drones. The instrument is designed for outdoor use and accordingly produces sound at high volume.

BACKGROUND OF THE INVENTION

A disadvantage of the instrument, however, is that it generally lacks versatility in volume control, rendering it unsuitable for use indoors. This retards the opportunity of practicing. While it is possible to acquire smaller bagpipes suitable for indoor use, the cost of purchasing a second instrument is undesirable and even, in some cases; prohibitive.

It is recognised in the present invention that it would be of considerable advantage if a highland bagpipe could be adjusted or adapted to be suitable, interchangeably, for both indoor and outdoor use. In this specification references to indoor use will imply that the instrument is adapted to perform or function at a relatively lower volume than that typical of a highland bagpipe.

The problem associated with conventional bagpipes is that they are costly to produce in known materials, such as wood. Furthermore, known bagpipes are large and difficult to manoeuvre. It is difficult and expensive to make smaller practise-pipes from known materials.

SUMMARY OF THE INVENTION

According to a first aspect of the invention there is provided a drone for use with a bagpipe, the drone comprising a means for connection with a plug stock on the bagpipe, the means also being connected with tubing made wholly or partly from metal.

According to a second aspect of the invention there is provided a set of bagpipes with two sets of interchangeable pipes or drones, said second set comprising of tubing, some or all of which is metallic.

The second set of drones may comprise of tubing of substantially smaller diameter than tubing associated with the first set of drones.

Preferably the metal is brass.

Optionally, some of the tubing is made from a plastics material. The tubing may be partially coated with heat-shrunk rubber.

Preferably the means is a conically shaped bunge, optionally made from a plastics or cork like material.

Preferably, a reed is attached to the bunge on the opposite side of said tubing. The reed may be a single or double reed, for example.

The tubing may comprise a plurality of overlapping aligned sections moveable in an axial direction relative to each other. The relative movement may be enabled by a sliding fit or a threaded joint between the adjacent sections.

Figure 2A:
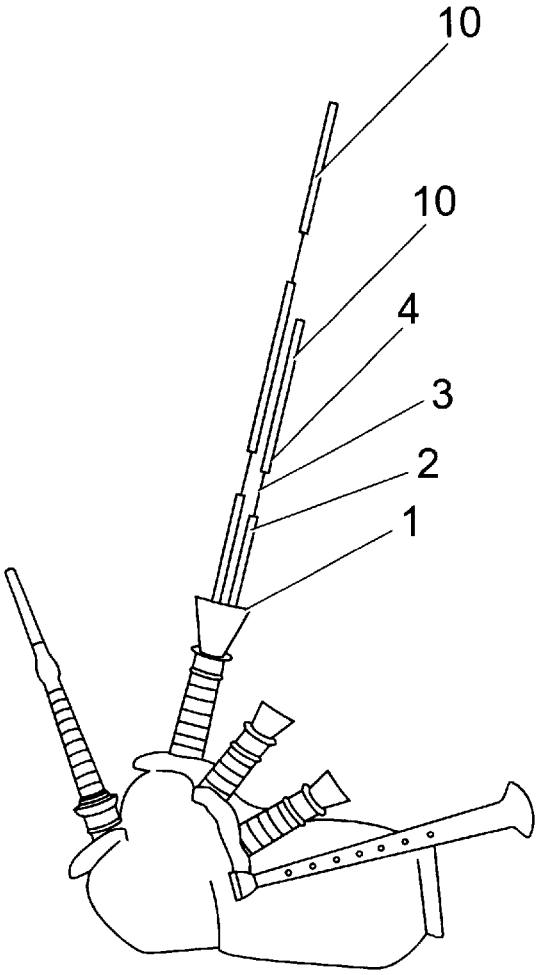
FIG. 2 is a front view of a set of bagpipes with two sets of interchangeable drones in accordance with the present invention.
Figure 2B:
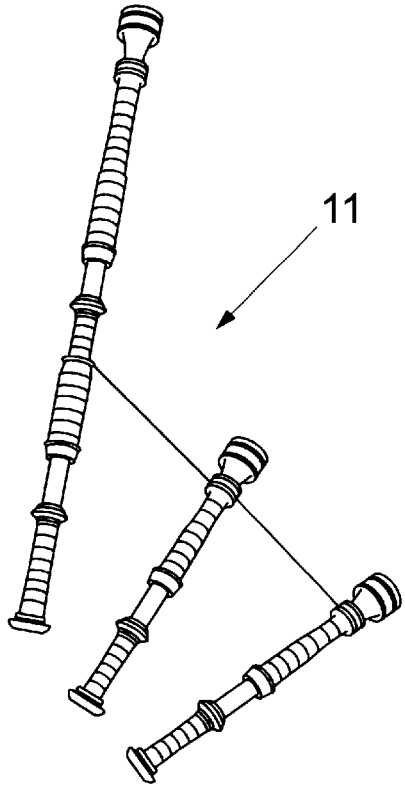

FIG. 2*a* is a front view of a set of bagpipes with a second set of drones in accordance with the present invention;

FIG. 2*b* is a front view of a first set of drones which may be interchanged with the second set of drones show in FIG. 2*a* in accordance with the present invention;

FIGS. 2*a* and 2*b* show a set of bagpipes with two sets of interchangeable drones, the first set of drones 11 being a conventional set (as illustrated in FIG. 2*b*) and a second set comprising drones 10 (as illustrated in FIG. 2*a*) described above.

Figure 3:
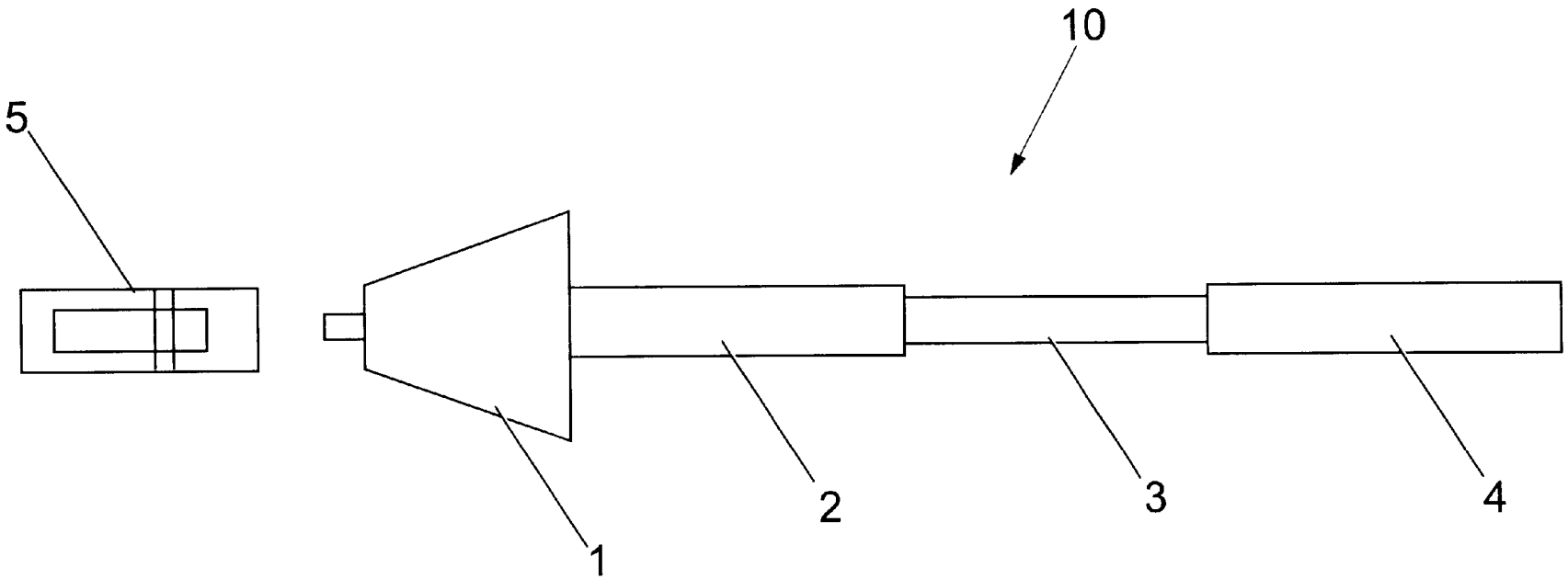

FIG. 3 is a side view of a drone in accordance with the invention and a reed.

DESCRIPTION OF THE INVENTION

Figure 1:
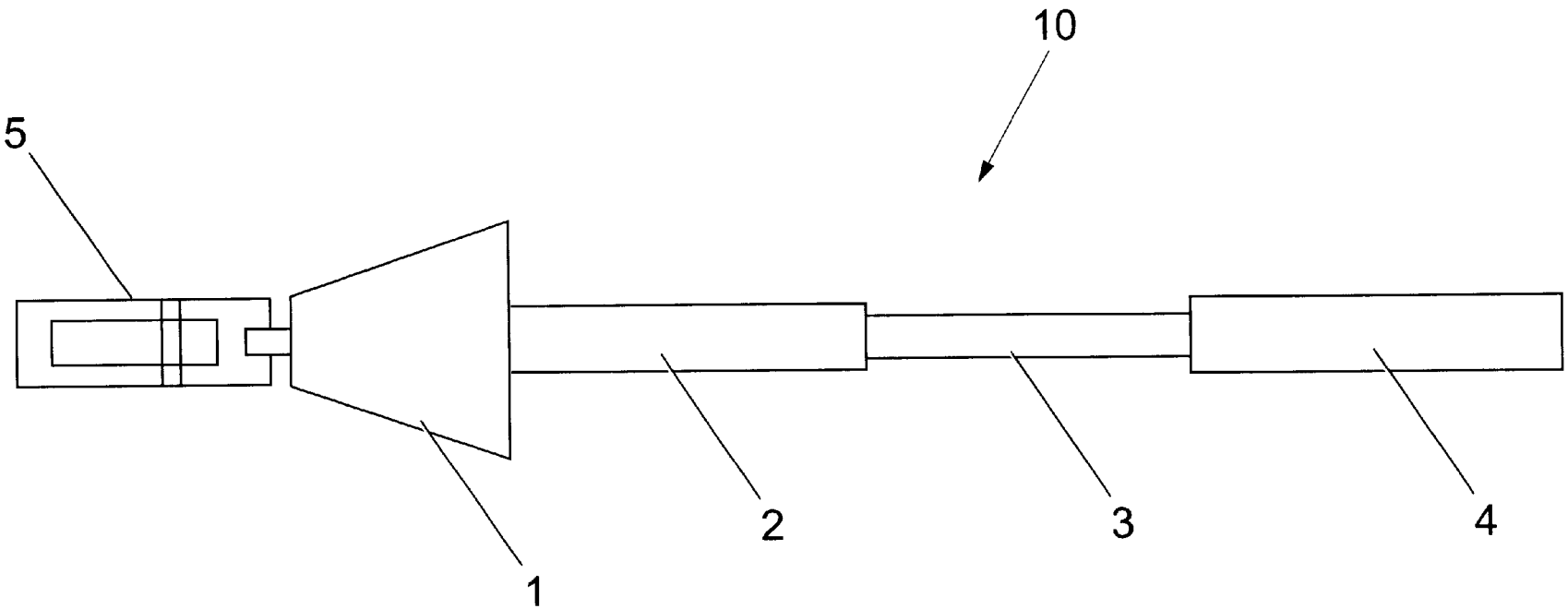
FIG. 1 is a side view of a drone in accordance with the invention with an attached reed.

A bagpipe drone s shown in FIG. 1 and generally referenced 10. The drone 10 comprises a rubber bung 1 which is of conical wedge cross-section and adapted to provide a means for fixing the drone 10 to the plug stock (not shown) on a highland bagpipe.

The bung 1 is connected to a plastic longitudinal tube 2 which connects, at its other end, to a bottom section comprising of a metallic tube 3. The metallic tube itself is connected at its opposite end to the plastic tube 2 to a top section 4 comprised of a further and larger diameter metallic tube.

The bunge 1 is of hollow construction to allow for the passing of air through the bunge 1 and into the tubing 2,3,4. Attached to the bunge 1 on the end opposite to the section 2 is provided a reed 5 for sound production. The reed can be sized to provide a suitable volume output to allow for the bagpipe with the drones to be comfortably used indoors.

The drone 10 illustrated in FIG. 1 is commonly referred to as a tenor drone; it also being known to provide bass drones which include a "middle section" in addition to a bottom and top section. The present invention is easily adapted for either type of drone.

In-the illustrated embodiment, the plastic portion 2, bottom section 3 and top section 4 are made of telescopic tubular construction and are connected to allow for relative axial or longitudinal movement. This movement enables the drones to be tuned. In the embodiment shown in the Figure the sections are of sufficiently similar diameter to allow for a sliding fit between them, there being sufficient frictional resistance between the respective sections to facilitate sliding only when desired. When tuning is required, the top section can be rotated to assist a longitudinal movement toward or away from the bung 1.

In the embodiment shown the portion 2 is made of plastics material, while the bottom and top sections are metallic, made, for example, from brass. Other metallic materials may be used, including for example aluminium and alloy materials. In this invention, it is appreciated that the plastic portion may be replaced by a metallic member.

However, it is similarly recognised in the present invention that the use of metallic tubing has considerable advantages in the production of drones of this type. It is beneficial to make the internal bore of the top section and indeed the outside circumferential area of the bottom section smooth, having in fact a glass-like finish. Using metallic materials enable this to be accomplished while also providing a strong and robust drone. Having smooth mating surfaces for the junction between the top and bottom sections not only has the advantage of enabling a good sliding fit, but also improves the integrity of the sound or music provided by the drone.

The use of metallic sections is viewed as advantageous over wood which tends to be brittle and splinter, while also being an improvement on plastics materials which generally require to be of much thicker and therefore larger construction in order to achieve the same strength characteristics.

Furthermore, metal tubing is available in standard telescopic incremental sizes which provides a cost advantage in terms of manufacture.

Yet further, metallic sections are less likely to wear thereby ensuring that the sliding fit maintains its integrity for a much longer period of time. In comparison, wood and plastics materials wear to a greater extent when subjected to similar use and time and this causes the sliding fit of adjacent sections to deteriorate. It is important that close tolerances are maintained to ensure that connecting sections are air tight. It is for this reason that the subject of wear is of importance in design and choice of materials.

In an alternative embodiment the top section may comprise an internal thread at its junction with an adjacent sections such as the middle section or bottom section. The said middle or bottom section would comprise of an external corresponding thread to allow the top section and middle or bottom section to be threadably engaged. With this design, tuning can be achieved by rotating one section relative to another to thereby cause relative axial movement of the sections. With this design, it is again advantageous to use metallic materials as these are easier to machine so as to create the required thread than wood or plastics materials. Furthermore, a metallic thread is less likely to burr or wear than would a plastics or other material.

A drone in accordance with the invention may also include a means for locking the relative positions of the tube sections.

FIG. 2 shows a set of bagpipes with two sets of interchangeable drones, the first set 11 being a conventional set and the second set comprising drones 10 described above.

FIG. 3 shows a side view of the drone 10 and a reed 5.

Further modifications and improvements may be incorporated without departing from the scope of the invention herein intended.

What is claimed is:

1. A drone for use with a bagpipe, the drone comprising a means for connection with a plug stock on the bagpipe, the drone further comprising tubing adapted to allow gas to flow therethrough, the tubing being connected with the said means for connection with the plug stock and the tubing being adapted for fluid communication with a reed, with at least a portion of the said tubing being made from metal, and wherein said gas flow comes into contact with the said metal portion of the tubing.

2. A drone as claimed in claim 1 wherein some of the tubing is made from a plastic material.

3. A drone as claimed in claim 1 wherein the tubing comprises of plurality of overlapping aligned sections moveable in an axial direction relative to each other.

4. A drone as claimed in claim 3 wherein the relative movement is enabled by a threaded joint between adjacent sections of the overlapping aligned sections of the tubing.

5. A set of bagpipes having a least one drone in accordance with claim 1.

6. A set of bagpipes with two sets of interchangeable drones, said second set including a drone comprising a means for connection with a plug stock on the bagpipe, the means also being connected with tubing adapted to allow gas to flow therethrough, with at least a portion of the tubing being made from metal, and wherein said gas flow comes into contact with the said metal portion of the tubing.

7. A set of bagpipes with two sets of interchangeable drones, said second set including a drone comprising a means for connection with a plug stock on the bagpipe, the means also being connected with tubing, with at least a portion of the tubing being made from metal, wherein the tubing of the second set of pipes is of substantially smaller diameter than tubing associated with the first set of pipes.

8. A drone for use with a bagpipe, the drone comprising a means for connection with a plug stock on the bagpipe, and the drone further comprising tubing, the tubing comprising a plurality of tubes connected to each other, the tubing being adapted for fluid communication with a reeds wherein the connection between two of the tubes is formed by a metal to metal sliding fit.

9. A drone as claimed in claim 8 wherein the metal is brass.

10. A drone as claimed in claim 9 wherein the tubing comprises a plurality of overlapping aligned sections movable in an axial direction relative to each other.

11. A drone as claimed in claim 10 wherein the overlapping aligned sections are of sufficiently similar diameter to allow for the sliding fit between them to provide sufficient frictional resistance to facilitate sliding only when desired.

* * * * *